US011786928B2

(12) United States Patent
Tang et al.

(10) Patent No.: US 11,786,928 B2
(45) Date of Patent: Oct. 17, 2023

(54) DISPENSING DEVICE AND DISPENSING METHOD

(71) Applicant: Fulian Yuzhan Precision Technology Co.,Ltd, Shenzhen (CN)

(72) Inventors: Ai-Jun Tang, Shenzhen (CN); Shi Chen, Shenzhen (CN); Wei-Zheng Wang, Shenzhen (CN); Jun-Yu Lin, Shenzhen (CN); Bo Yang, Shenzhen (CN); Jian-Guo Liao, Shenzhen (CN)

(73) Assignee: Fulian Yuzhan Precision Technology Co., Ltd, Shenzhen (CN)

( * ) Notice: Subject to any disclaimer, the term of this patent is extended or adjusted under 35 U.S.C. 154(b) by 429 days.

(21) Appl. No.: 17/017,463

(22) Filed: Sep. 10, 2020

(65) Prior Publication Data

US 2021/0154696 A1 May 27, 2021

(30) Foreign Application Priority Data

Nov. 27, 2019 (CN) ..... 201911178899.5
Nov. 27, 2019 (CN) ..... 201911179150.2
Nov. 27, 2019 (CN) ..... 201911179192.6

(51) Int. Cl.
*B05C 5/02* (2006.01)
*B05B 15/555* (2018.01)

(52) U.S. Cl.
CPC ..... *B05C 5/0225* (2013.01); *B05B 15/555* (2018.02); *B05C 5/0212* (2013.01)

(58) Field of Classification Search
USPC ..... 118/712, 302
See application file for complete search history.

(56) References Cited

U.S. PATENT DOCUMENTS

2006/0251797 A1* 11/2006 Erfle ..... B05C 5/02 118/712
2013/0337164 A1 12/2013 Huang et al.
2014/0230727 A1* 8/2014 Suriawidjaja ..... G01B 11/026 118/712

FOREIGN PATENT DOCUMENTS

CN 103506247 A 1/2014
CN 105080787 A 11/2015
CN 105817397 A 8/2016
CN 106733464 A 5/2017
CN 106950917 A 7/2017

OTHER PUBLICATIONS

English Translation CN-105080787A (Year: 2015).*

* cited by examiner

*Primary Examiner* — Yewebdar T Tadesse
(74) *Attorney, Agent, or Firm* — ScienBiziP, P.C.

(57) ABSTRACT

A dispensing device includes a dispensing mechanism and a calibration mechanism coupled to the dispensing mechanism. The calibration mechanism includes a control unit. The control unit is configured to detect a position difference between a dispensing needle and a reference coordinate in a direction. The dispensing mechanism is configured to adjust the dispensing needle in the direction according to the position difference.

10 Claims, 7 Drawing Sheets

DISPENSING DEVICE AND DISPENSING METHOD

FIELD

The subject matter herein generally relates to dispensing devices, and more particularly to a glue dispensing device and a method for dispensing glue.

BACKGROUND

In a dispensing process, the dispensing needle may become clogged and needs to be replaced. The position of the dispensing needle needs to be recalibrated to ensure normal operation of dispensing. Generally, the position is calibrated by three sets of fiber optic sensors to adjust the position in three directions. However, the calibration by of the fiber optic sensors is indirect, and the three sets of fiber optic sensors have a high cost, take up a lot of space, and have a long calibration time.

At the same time, the needle of the dispensing needle is easily clogged, and it is often necessary to remove the excess glue from the dispensing needle to ensure the normal operation of the dispensing operation. However, most of the existing glue cleaning devices use mechanical pinch to remove the excess glue. Due to direct contact with the tip of the needle, the needle tip is prone to impact and bending, causing unnecessary damage.

BRIEF DESCRIPTION OF THE DRAWINGS

Implementations of the present disclosure will now be described, by way of embodiments, with reference to the attached figures.

DETAILED DESCRIPTION

Figure 1:
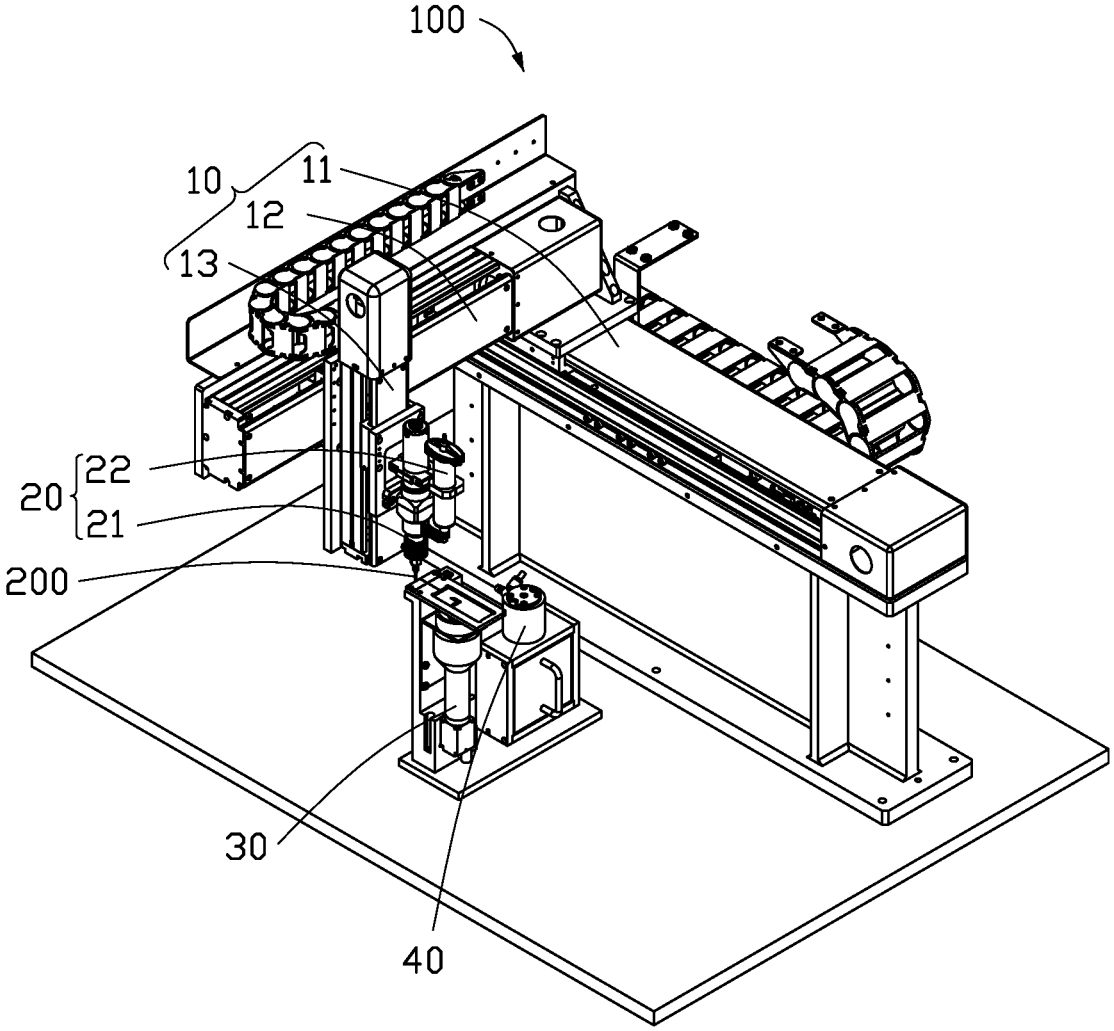
FIG. 1 is an assembled, isometric view of an embodiment of a dispensing device.

It will be appreciated that for simplicity and clarity of illustration, where appropriate, reference numerals have been repeated among the different figures to indicate corresponding or analogous elements. Additionally, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising" means "including, but not necessarily limited to"; it specifically indicates open-ended inclusion or membership in a so-described combination, group, series and the like.

FIG. 1 shows an embodiment of a dispensing device 100. The dispensing device 100 is for calibrating a dispensing needle 200 replaced on a machine table. The dispensing device 100 includes a moving mechanism 10, a dispensing mechanism 20, and a calibration mechanism 30. The dispensing mechanism 20 is mounted on the moving mechanism 10. The dispensing mechanism 20 mounts the dispensing needle 200 and controls the dispensing needle 200 to dispense glue. The moving mechanism 10 controls movement of the dispensing needle 200 on the dispensing mechanism 20. The calibration mechanism 30 is coupled to the moving mechanism 10 and the dispensing mechanism 20. The calibration mechanism 30 calibrates the dispensing needle 200.

The moving mechanism 10 includes a first driving member 11, a second driving member 12, and a third driving member 13. The second driving member 12 is mounted on the first driving member 11. The first driving member 11 drives the second driving member 12 to move in a first direction. The third driving member 13 is mounted on the second driving member 12. The second driving member 12 drives the third driving member 13 to move in a second direction. The dispensing mechanism 20 is mounted on the third driving member 13. The third driving member 13 drives the dispensing mechanism 20 to move in a third direction. In one embodiment, the third direction is a height direction, and the first direction, the second direction, and the third direction are perpendicular to each other.

The dispensing mechanism 20 includes a mounting base 21 and a dispensing valve 22. The mounting base 21 mounts the dispensing needle 200. The dispensing valve 22 controls the dispensing needle 200 mounted on the mounting base 21 to dispense glue.

Figure 2:
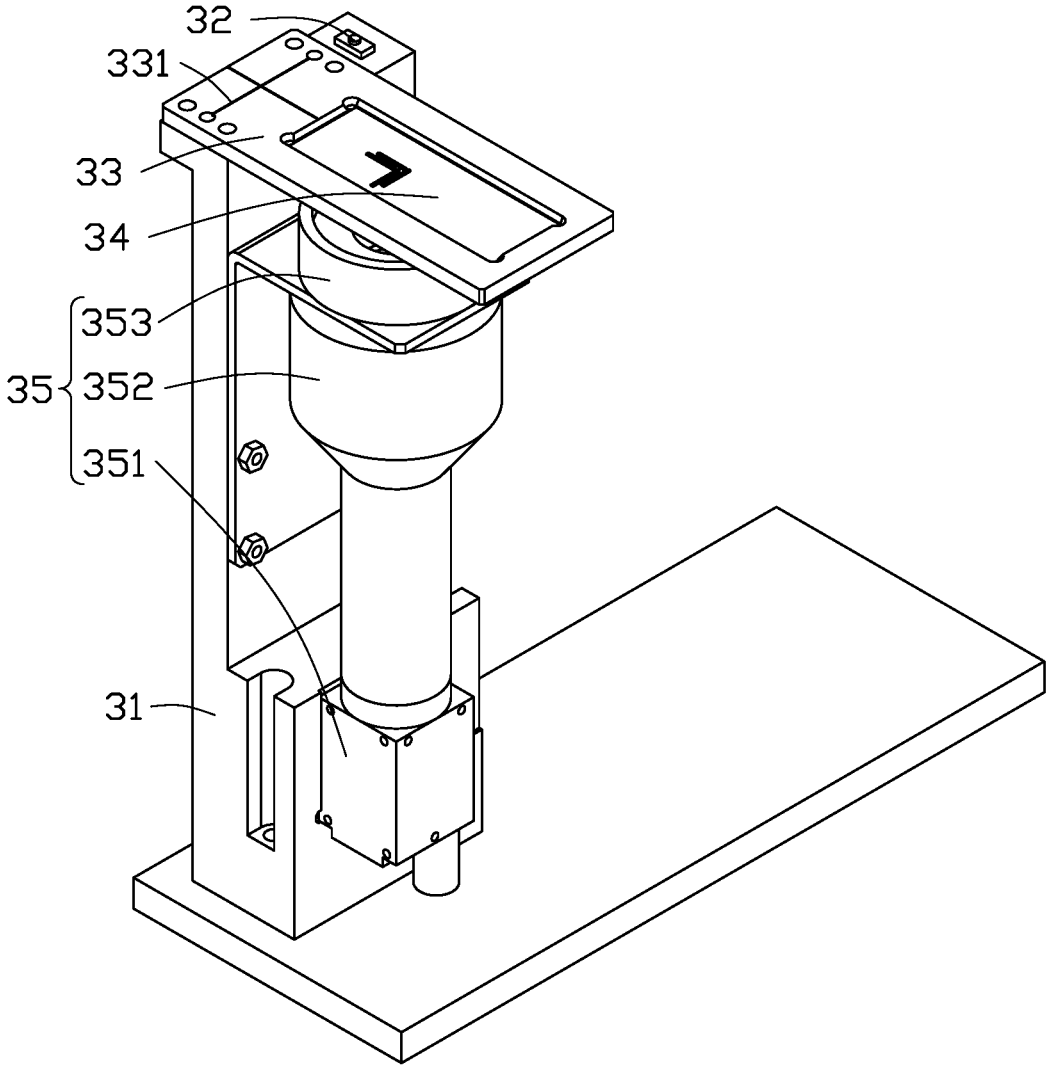
FIG. 2 is an isometric view of a calibration mechanism of the dispensing device in FIG. 1.

Referring to FIG. 2, the calibration mechanism 30 includes a fixing base 31, a control unit 32, a placement plate 33, a slide 34, a detection unit 35, and a processor (not shown). The control unit 32 is located on a side of the fixing base 31 adjacent to the dispensing mechanism 20. The control unit 32 detects a position difference between the dispensing needle 200 and a reference coordinate in the third direction. The placement plate 33 is located on the fixing base 31 adjacent to the control unit 32. The slide 34 is located on the placement plate 33. The slide 34 is used when the dispensing needle 200 dispenses in the first direction and the second direction to form a glue path. The slide 34 is provided with a reference line set (not shown). The reference line set is reference coordinates in the first direction and the second direction. In one embodiment, the detection unit 35 is mounted on the fixing base 31, and includes an imaging device which faces the slide 34. The detection unit 35 cooperates with the slide 34 to detect the glue path by the dispensing needle 200 dispensing in the first direction and the second direction. The processor controls the moving mechanism 10 to adjust the dispensing needle 200 according to a detection result of the control unit 32 and the detection unit 35.

Specifically, the control unit 32 includes a controller and a switch. The controller controls the third driving member 13 of the moving mechanism 10 to move the dispensing needle 200 in the third direction. The switch obtains detection information based on contact with the dispensing needle 200. In one embodiment, the detection information is a third direction coordinate, and the switch is a micro switch.

The processor controls the dispensing needle 200 to contact the micro switch to obtain the third direction coordinate of the dispensing needle 200, thereby detecting an average deviation of the dispensing needle 200 in the third direction, according to the third direction coordinate to obtain the position difference between the dispensing needle 200 and the reference coordinate in the third direction.

Specifically, the processor obtains the position difference between the dispensing needle 200 and the reference coordinate in the third direction by the following method:

Controlling the dispensing needle 200 in contact with the switch to move a preset distance away from the switch in the third direction;

Controlling the dispensing needle 200 to contact the switch again to obtain a calibration third direction coordinate;

Determining whether the difference between the calibration third direction coordinate and the reference third direction coordinate is within an allowable tolerance;

If the difference between the calibration third direction coordinate and the reference third direction coordinate is within the allowable tolerance, the average value of the calibration third direction coordinate and the reference third direction coordinate is obtained to obtain the position difference;

If the difference between the calibration third direction coordinate and the reference third direction coordinate is not within the allowable tolerance, the calibration third direction coordinate is obtained again, and whether the difference between the calibration third direction coordinate and the reference third direction coordinate is within an allowable tolerance is determined a second time;

If the difference between the calibration third direction coordinate and the reference third direction coordinate is still not within the allowable tolerance, a warning unit (not shown) is controlled to give an alarm to an operator.

In one embodiment, the detection unit 35 includes a detector 351, a lens 352, and a light source 353. The detector 351 is mounted on the fixing base 31 and faces the slide 34. The lens 352 is mounted on the detector 351. The light source 353 is mounted on the lens 352 and faces the slide 34. The detector 351 photographs glue dispensed on the glue path on the slide 34 and the reference line set to obtain detection information. The detection information is an image. The processor detects a width of the glue path according to the image and detects a distance difference between the glue path and the reference line set.

Specifically, the processor obtains the width of the glue path and the distance difference by the following method:

Controlling the dispensing valve 22 and the moving mechanism 10 to form a section of the glue path on the glass slide 34;

Controlling the detector 351 to photograph the glue path and the reference line set to obtain detection information;

According to the detection information, taking any point on the glue path as a base point, forming a first vector from the base point extending along an extension direction of the glue path, obtaining a width of the glue path on the first vector, and obtaining a line segment of the glue path on the first vector, wherein a midpoint of the line segment is a midpoint of the glue path at the point;

Obtaining a plurality of widths of the glue path at a plurality of points to form a width set, calculating an average value of the width set to obtain the width of the glue path, obtaining a plurality of midpoints to form a midpoint set, calculating an average value of the midpoint set to obtain a midpoint of the glue path, and calculating a distance from the midpoint to the reference line set to obtain the distance difference;

Controlling the dispensing valve 22 and the moving mechanism 10 to adjust the dispensing needle 200 according to the width of the glue path and the distance difference to form a calibrated glue path on the slide 34.

The placement plate 33 is provided with a cross-shaped calibration score 331 for aiding in visual debugging.

In one embodiment, the detector 351 is a CCD camera.

Figure 3:
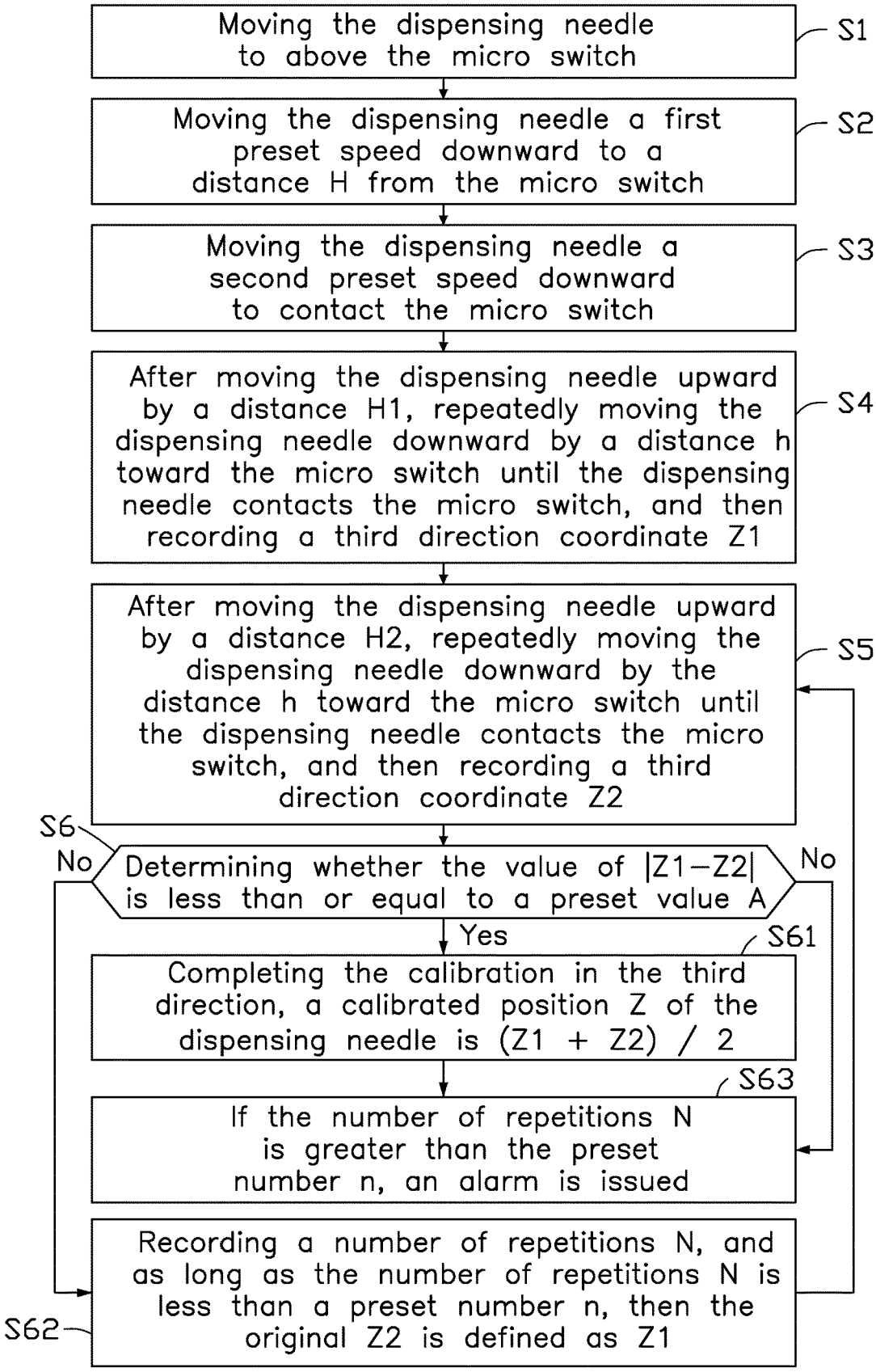
FIG. 3 is a flowchart of an embodiment of a method of calibrating a third direction of the dispensing device.

FIG. 3 shows an embodiment of a method of calibrating the third direction:

Block S1, the dispensing needle 200 is moved above the micro switch.

Specifically, the first driving member 11 and the second driving member 12 of the moving mechanism 10 control the dispensing needle 200 provided on the dispensing mechanism 20 to move in the first direction and the second direction, thereby the dispensing needle 200 is moved to above the micro switch.

Block S2, the third driving member 13 drives the dispensing needle 200 to move a first preset speed downward to a distance H from the micro switch in the third direction.

Specifically, the distance H is about 5 mm.

Block S3, the third driving member 13 drives the dispensing needle 200 to move a second preset speed downward to contact the micro switch.

Specifically, the second preset speed is slower than the first preset speed, and the dispensing needle 200 contacting the micro switch triggers the micro switch thereby the dispensing needle 200 stops moving.

Block S4, after the third driving member 13 controls the dispensing needle 200 to move upward by a distance H1, the dispensing needle 200 is repeatedly moved downward by a distance h toward the micro switch until the dispensing needle 200 contacts the micro switch, and a third direction coordinate Z1 is recorded. In one embodiment, $h<H1<H$.

Specifically, the dispensing needle 200 is moved upward by 0.5 mm, and the dispensing needle 200 is repeatedly moved downward by 0.01 mm until the dispensing needle 200 contacts the micro switch to trigger the micro switch to stop the dispensing needle 200 from moving.

Block S5, after the third driving member 13 drives the dispensing needle 200 to move upward by a distance H2, the dispensing needle 200 is repeatedly moved downward by the distance h toward the micro switch until the dispensing needle 200 contacts the micro switch, and a third direction coordinate Z2 is recorded. In one embodiment, $h<H2<H1$.

Specifically, the dispensing needle 200 is moved upward by 0.1 mm, and the dispensing needle 200 is repeatedly moved downward by 0.01 mm until the dispensing needle 200 contacts the micro switch to trigger the micro switch to stop the dispensing needle 200 from moving.

Block S6, whether the value of $|Z1-Z2|$ is smaller than or equal to a preset value A.

Block S61, if the value of |Z1−Z2| is smaller than or equal to the preset value A, the calibration in the third direction is complete, and a calibrated position Z of the dispensing needle 200 is (Z1+Z2)/2;

Block S62, if the value of |Z1−Z2| is greater than the preset value A, a number of repetitions N is recorded, and as long as the number of repetitions N is smaller than a preset number n, then the original Z2 is defined as Z1, and blocks S5-S6 are repeated;

In step S63, if the value of |Z1−Z2| is greater than the preset value A and the number of repetitions N is greater than the preset number n, an alarm is issued.

Specifically, whether the value of |Z1−Z2| is smaller than or equal to 0.04 mm is determined. If the value of |Z1−Z2| is smaller than or equal to 0.04 mm, the calibration in the third direction is completed. If the number of repetitions N is greater than 3, an alarm is issued for manual investigation.

Figure 4:
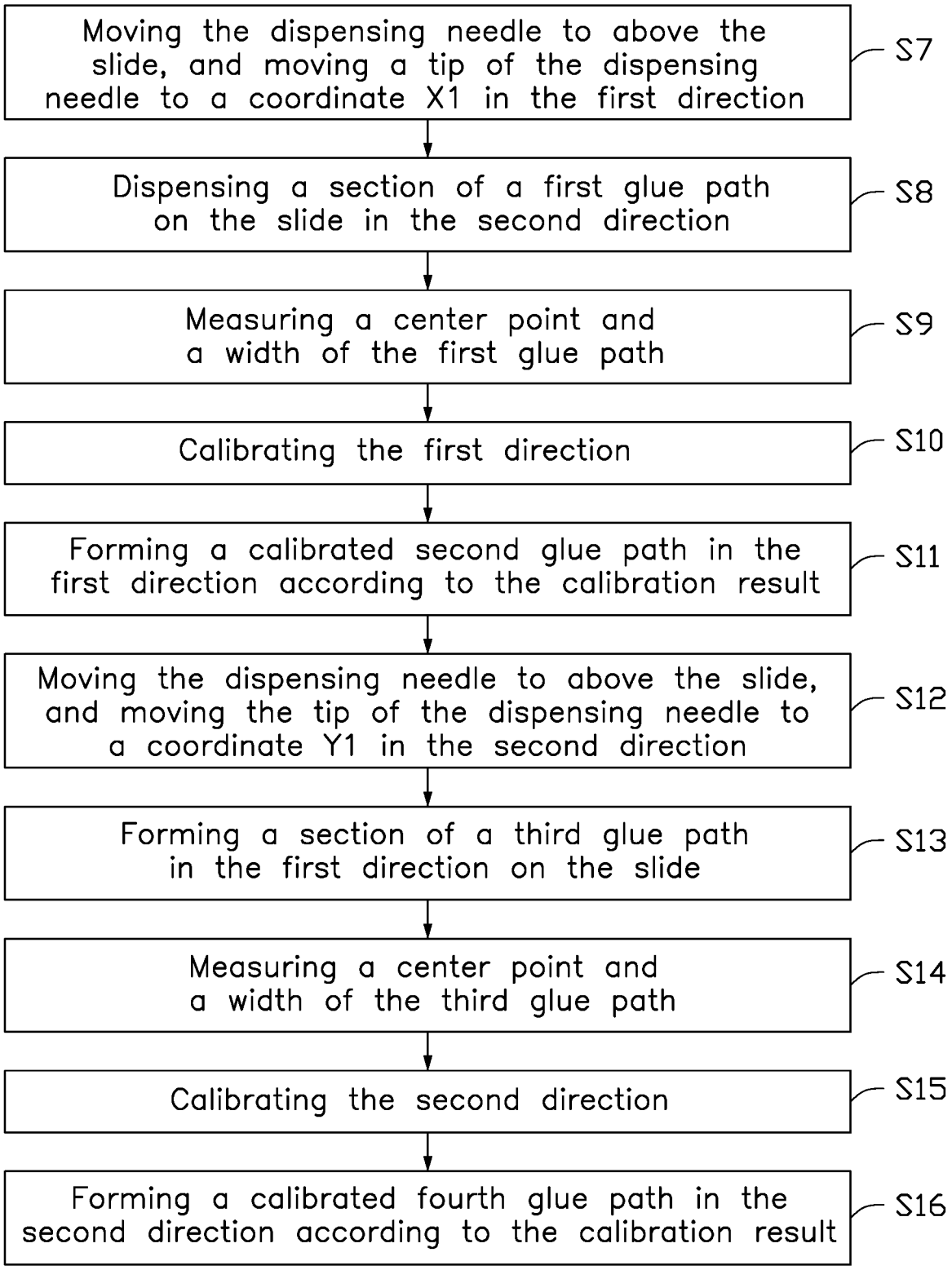
FIG. 4 is a flowchart of an embodiment of a method of calibrating a first direction and a second direction of the dispensing device.

FIG. 4 shows an embodiment of a method of calibrating the first direction and the second direction:

Block S7, the dispensing needle 200 is moved to above the slide 34, and a tip of the dispensing needle 200 is moved to a coordinate X1 in the first direction.

Specifically, the center of the reference line set on the slide 34 is defined as the origin, and coordinates of the first and second direction passing through the origin are defined as X0 and Y0. The first driving member 11, the second driving member 12, and the third driving member 13 of the moving mechanism 10 control the movement of the dispensing needle 200 in the first direction, the second direction, and the third direction, respectively. The tip of the dispensing needle 200 is moved to the coordinate X1 in the first direction, and X1=X0+2 mm. A distance between the tip of the dispensing needle 200 and a surface of the slide 34 is a dispensing gap.

Block S8: a section of a first glue path is dispensed on the slide 34 in the second direction.

Specifically, the second driving member 12 drives the dispensing needle 200 to move in the second direction, and the dispensing needle 200 is controlled by the dispensing valve 22 to dispense glue. A length of the segment of the first glue path in the second direction is 10 mm.

Block S9, a center point and a width of the first glue path are measured.

Specifically, the detector 351 photographs the first glue path and the reference line set to obtain detection information. A front and back section of the first glue path affected by the glue starting and stopping are removed, such as 2 mm, and the processor evenly obtains points in a remaining section of the glue path in the second direction and measures a width XH1 and a midpoint XM1 of the glue path at the respective points. The width XH1 of the glue path at each point is a difference between coordinate boundaries of two sides of the glue path in the first direction, and the midpoint XM1 of the glue path at each point is an average value of the coordinate boundaries of the two sides of the glue path in the first direction. Then, an average value of the widths XH1 and an average value of the midpoints XM1 of the glue path are calculated to obtain a width XH and a midpoint XM of the first glue path.

Block S10, the first direction is calibrated.

Glue width is an important parameter of glue dispensing. When all parameters of glue dispensing are consistent, a corresponding relationship exists among the width, thickness, and weight of the glue. Thus, by knowing the glue width, the other parameters of glue dispensing are known.

Specifically, the width of the first glue path is compared to a standard width. If the width of the first glue path is within an error range, it is determined that the first direction meets requirements. If the width of the first glue path exceeds the error range, an alarm is issued. A distance difference of the dispensing needle 200 in the first direction is XM−X1, and the tip of the dispensing needle 200 in the first direction is calibrated according to the distance difference.

Block S11, according to the calibration result, a calibrated second glue path is formed in the first direction.

Specifically, according to the width XH and the distance difference of the first glue path, a calibrated second glue path is formed in the first direction by the dispensing needle 200.

A method of calibrating the second direction includes:

Block S12, the dispensing needle 200 is moved to above the slide 34, and the tip of the dispensing needle 200 is moved to a coordinate Y1 in the second direction.

Specifically, the first driving member 11, the second driving member 12, and the third driving member 13 of the moving mechanism 10 control the movement of the dispensing needle 200 in the first direction, the second direction, and the third direction, respectively. The tip of the dispensing needle 200 is moved to the coordinate Y1 in the second direction, and Y1=Y0+2 mm. A distance between the tip of the dispensing needle 200 and a surface of the slide 34 is a dispensing gap.

Block S13: a section of a third glue path is formed in the first direction on the slide 34.

Specifically, the first driving member 11 controls the dispensing needle 200 to move in the first direction, and the dispensing needle 200 is controlled by the dispensing valve 22 to dispense glue. A length of the segment of the third glue path in the first direction is 10 mm.

Block S14, a center point and a width of the third glue path are measured.

Specifically, the detector 351 photographs the third glue path and the reference line set to obtain detection information. A front and back section of the third glue path affected by the glue starting and stopping are removed, such as 2 mm, and the processor evenly obtains points in a remaining section of the glue path in the first direction and measures a width YH1 and a midpoint YM1 of the glue path at the respective points. The width YH1 of the glue path at each point is a difference between coordinate boundaries of two sides of the glue path in the second direction, and the midpoint YM1 of the glue path at each point is an average value of the coordinate boundaries of the two sides of the glue path in the second direction. Then, an average value of the widths YH1 and an average value of the midpoints YM1 of the glue path are calculated to obtain a width YH and a midpoint YM of the third glue path.

Block S15, the second direction is calibrated.

Specifically, a distance difference of the dispensing needle 200 in the second direction is YM−Y1, and the tip of the dispensing needle 200 in the second direction is calibrated according to the distance difference.

Block S16, according to the calibration result, a calibrated fourth glue path is formed in the second direction.

Specifically, according to the width YH and the second distance difference of the third glue path, a calibrated fourth glue path is formed in the second direction by the dispensing needle 200.

The dispensing device 100 and the calibration method calibrate the dispensing needle 200 in the third direction by using the control unit 32, and calibrate the first direction and the second direction of the dispensing needle 200 by using the detection unit 35. The structure is simple, the cost is low, the calibration is accurate, and the time required for calibration is short, thereby the efficiency is improved.

Figure 5:
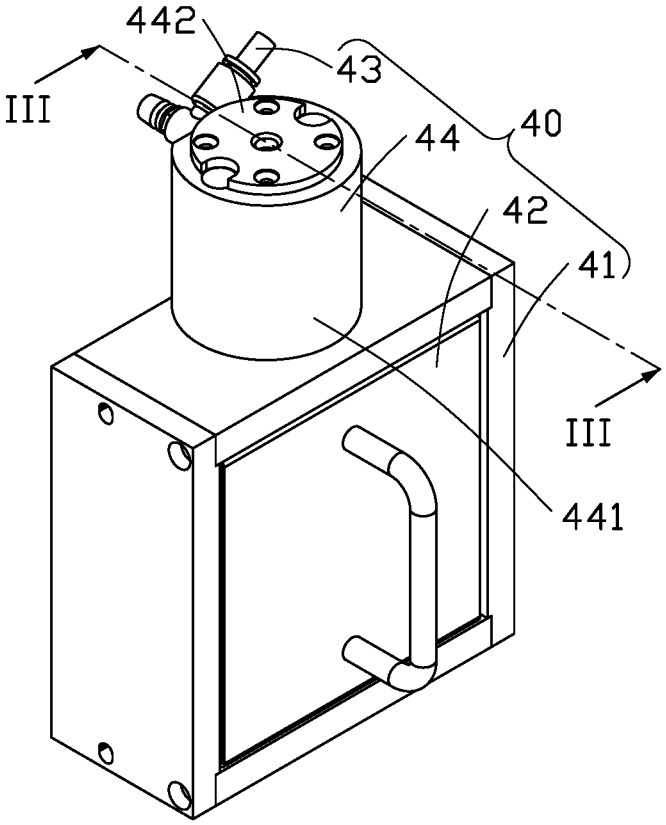
FIG. 5 is a schematic perspective view of a cleaning mechanism of the dispensing device shown in FIG. 1.

As shown in FIG. 5, the dispensing device 100 further includes a glue cleaning mechanism 40 for cleaning excess glue from the glue needle 200 on the machine table after the dispensing needle 200 dispenses glue.

The dispensing mechanism 20 includes a mounting base 21 and a dispensing valve 22. The mounting base 21 is used to install the dispensing needle 200. The dispensing valve 22 is used to control the dispensing needle 200 installed on the mounting base 21 to dispense.

Figure 6:
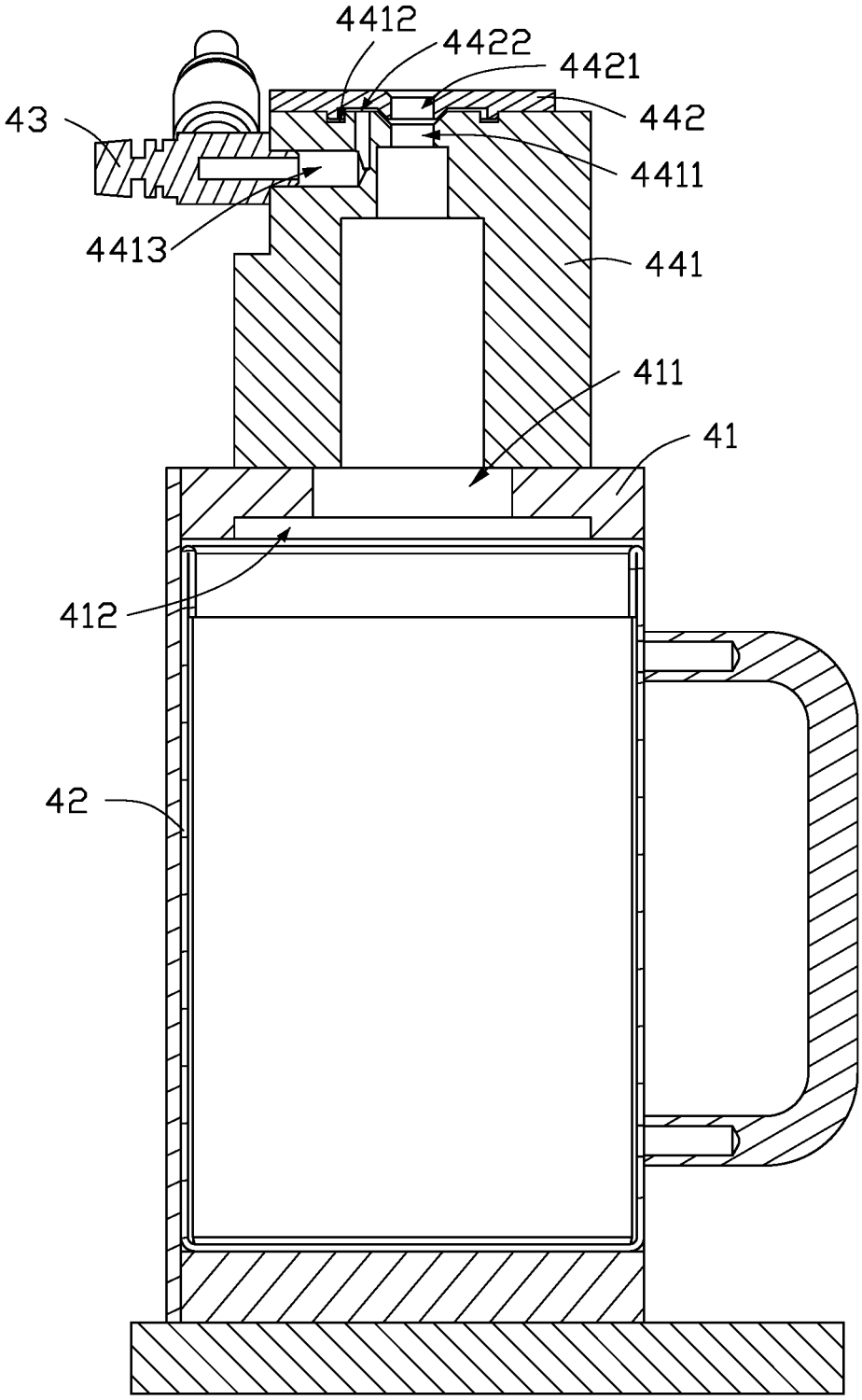
FIG. 6 is a cross-sectional view of the cleaning mechanism taken along line III-III in FIG. 6.

Referring to FIG. 5 and FIG. 6, the glue cleaning mechanism 40 includes a base 41, a waste receptacle 42, an air inlet connector 43, and a cleaning assembly 44. The cleaning assembly 44 is disposed on the base 41. The cleaning assembly 44 is used for removing the excess glue of the dispensing needle 200. The waste receptacle 42 is mounted on the base 41 and is located below the cleaning assembly 44. The waste receptacle 42 is used to collect the excess glue removed by the cleaning assembly 44. The air inlet connector 43 is mounted on the cleaning assembly 44. The air inlet connector 43 is connected to a high-pressure gas source to supply high-pressure gas to the cleaning assembly 44.

Specifically, the cleaning assembly 44 includes an air knife base 441 and an air knife cover 442. The air knife base 441 is located on the base 41. The air knife cover 442 is covered on the air knife base 441. The air knife base 441 is provided with a glue drop hole 4411. The air knife cover 442 is provided with a cleaning hole 4421 opposite to the glue drop hole 4411. The cleaning hole 4421 is used to accommodate the dispensing needle 200 extending into it. An air guide groove 4422 is formed on the side of the air knife cover 442 facing the air knife base 441 around the cleaning hole 4421. The annular side wall of the air guide groove 4422 near the cleaning hole 4421 forms an acute angle with the wall of the cleaning hole 4421. The diameter of the glue drop hole 4411 adjacent to the end of the air knife cover 442 gradually increases in a direction toward the air knife cover 442, so as to cooperate with the annular side wall of the air guide groove 4422 to form an annular inclined passage toward the central axis of the glue drop hole 4411. A surface of the air knife base 441 facing the air knife cover 442 defines a matching groove 4412 opposite the air guide groove 4422. An air hole 4413 is defined in the wall surface of the matching groove 4412. One end of the air hole 4413 communicates with the air inlet connector 43, and the other end communicates with the matching groove 4412.

Gas flowing out of a high-pressure gas source enters the air guide groove 4422 and the matching groove 4412 through the air inlet connector 43 and the air guide hole 4413, and passes through the annular side wall of the air guide groove 4422 and the hole wall of the glue drop hole 4411 to convert into an annular air knife inclined downward toward the central axis of the glue hole 4411, thereby the dispensing needle 200 extending into the glue hole 4411 can be cleaned.

Preferably, the acute angle formed between the side wall of the air guide groove 4422 and the hole wall of the cleaning hole 4421 ranges from 30° to 60°. When the acute angle is 30°, the formed annular air knife is longer along the central axis of the glue hole 4411, and the strength is weaker, which is suitable for cleaning the dispensing needle 200 with a smaller diameter. When the acute angle is 60°, the formed annular air knife is shorter along the central axis of the dispensing hole 4411 and is stronger, and is suitable for cleaning the dispensing needle 200 with a larger diameter. The air knife formed at an acute angle of 45° can adequately clean most of the dispensing needles 200.

A surface of the base 41 facing the air knife base 441 is provided with a collection hole 411 opposite to the glue drop hole 4411. The waste receptacle 42 is located below the collection hole 411.

An annular anti-flow groove 412 is opened on a surface of the collection hole 411 facing the waste receptacle 42. The anti-flow groove 412 is used to prevent the excess glue falling from the collection hole 411 from flowing down along the wall surface of the base 41 without dripping into the waste receptacle 42.

Figure 7:
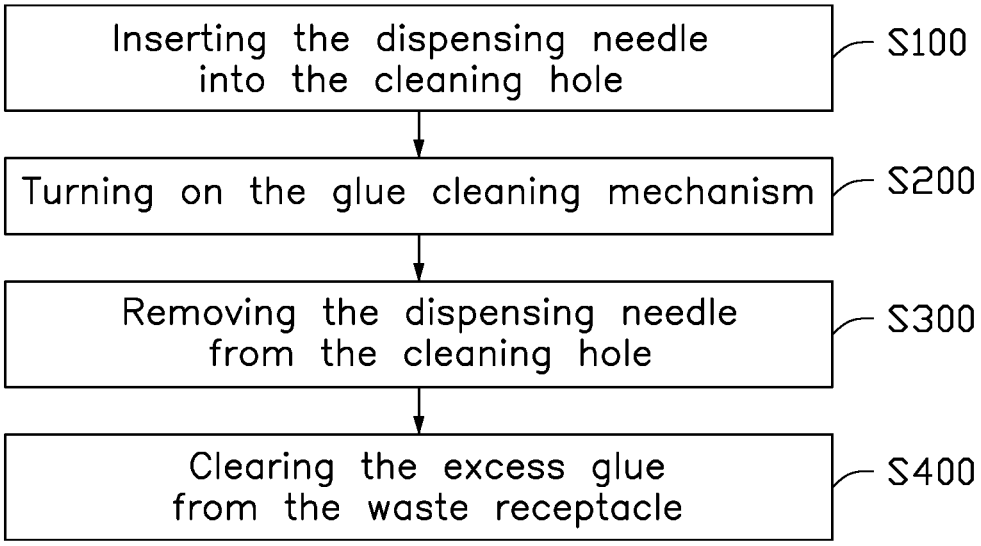
FIG. 7 is a flowchart of an embodiment of a glue cleaning method.

Referring to FIG. 7, an embodiment of the present disclosure also provides a glue cleaning method, including:

Connecting to a high-pressure gas source through the air inlet connector 43;

Controlling airflow to flow into the air inlet connector 43;

Guiding the airflow into the air guide groove 4422 through the air hole 4413 and the matching groove 4412; and Converting the airflow into an annular air knife inclined downward and facing the central axis of the glue drop hole 4411 through the annular side wall of the air guide groove 4422 and the hole wall of the glue drop hole 4411.

An embodiment of the present disclosure also provides a method for cleaning a dispensing needle, including the following blocks:

At block S100, the dispensing needle 200 after dispensing is extended into the cleaning hole 4421.

Specifically, through the cooperation of the moving mechanism 10 and the calibration mechanism 30, the dispensing needle 200 is calibrated. After the dispensing needle 200 is used for a period of time, excess glue will appear in the attachment of the dispensing needle 200. The first driving member 11 and the second driving member 12 are used to control the dispensing needle 200 to move in the first direction and the second direction, thereby the dispensing needle 200 moves above the air knife cover 442, and the third driving member 13 controls the glue needle 200 to move rapidly in the third direction, thereby the needle of the glue needle 200 extends into the cleaning hole 4421 and enters the glue drop hole 4411 of the air knife base 441.

At block S200, the glue cleaning mechanism 40 is turned on.

Specifically, the high-pressure gas source is connected, thereby the high-pressure gas enters the air guide groove 4422 and the matching groove 4412 through the air inlet connector 43 and the air hole 4413, and passes through the annular side wall of the air guide groove 4422 and the hole wall of the glue drop hole 4411 to form an annular air knife that is inclined downward toward the center of the glue hole 4411.

At block S300, the dispensing needle 200 is slowly moved upward and removed out of the cleaning hole 4421.

Specifically, the third driving member 13 controls the tip of the dispensing needle 200 to slowly move upward in the third direction. When the tip of the dispensing needle 200 moves slowly upward, the annular air knife cleans the excess glue on the tip of the dispensing needle 200. When the dispensing needle 200 is removed from the cleaning hole 4421, the excess glue on the needle can be cleaned.

Because the annular air knife is inclined downward by 45° and surrounds 360°, the needle of the dispensing needle 200 can be efficiently cleaned without a dead angle with high efficiency and cleanliness.

At block S400, the excess glue collected in the waste receptacle 42 is cleaned.

Specifically, after the excess glue on the dispensing needle 200 is cleaned by the annular air knife, the glue will fall down into the waste receptacle 42 and the excess glue in the waste receptacle 42 may be removed and cleaned regularly.

In the glue cleaning device, the air knife forming method, and the cleaning method, the air inlet connector is connector to the airflow, the airflow is converted into an air knife through the cleaning assembly, and the excess glue on the dispensing needle is removed by the air knife, which is convenient and fast, and there will be no damage to the needle. The structure is simple, the cost is low, and efficiency is improved.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. A dispensing device comprising:

a dispensing mechanism configured to form a first glue path; and a calibration mechanism coupling to the dispensing mechanism and comprising a detection unit, wherein the detection unit is configured to detect a width of the first glue path and a distance difference between the first glue path and a reference line set;

wherein the dispensing mechanism is further configured to form a second glue path based on the width of the first glue path and the distance difference, the calibration mechanism further comprises a slide, the dispensing mechanism forms the first glue path on the slide, the detection unit comprises a detector, the detector is configured to detect the first glue path on the slide to obtain an image and calculate the width of the first glue path based on the image;

or the detector is configured to detect the first glue path to obtain detection information, the detection unit is further configured to calculate a midpoint of the first glue path based on the detection information and the reference line set, and calculate a distance difference between the midpoint and the reference line set.

2. The dispensing device of claim 1, wherein:

the dispensing mechanism is further configured to form a third glue path perpendicular to the second glue path;

the detection unit is further configured to detect a second distance difference between the third glue path and the reference line set; and the dispensing mechanism is configured to form a fourth glue path based on the second distance difference.

3. The dispensing device of claim 1, comprising a dispensing needle, wherein:

the calibration mechanism further comprises a control unit; the control unit is configured to:

control the dispensing needle to contact with a switch in a direction, wherein the direction is perpendicular to the first glue path;

detect a position difference between the dispensing needle and a reference coordinate in the direction; and the dispensing mechanism is further configured to adjust the dispensing needle in the direction based on the position difference.

4. The dispensing device of claim 3, wherein the control unit is further configured to:

control the dispensing needle to contact with the switch to move a preset distance away from the switch;

control the dispensing needle to contact the switch a second time to obtain a second the direction coordinate; and obtain a plurality of the direction coordinates to form a direction coordinate set, and calculate an average value of the direction coordinate set to obtain the position difference.

5. The dispensing device of claim 1, further comprising an air inlet connector and a cleaning assembly, wherein:

the cleaning assembly comprises a air knife base and a air knife cover; wherein the air knife cover on the air knife base couples to the air inlet connector; and the cleaning assembly is configured to:

convert the airflow from the air inlet connector into an air knife by the air knife base and the air knife cover; and clean a excess glue from the dispensing needle by the air knife.

6. The dispensing device of claim 5, wherein:

the air knife base comprises a glue drop hole, wherein the annular air knife is formed inside the glue drop hole; and the air knife cover comprises a cleaning hole, wherein the cleaning hole is configured to accommodate the dispensing needle extending into it.

7. The dispensing device of claim 6, wherein the air knife cover further comprises an air guide groove, wherein:

the air guide groove couples to the air inlet connector and formed on the side of the air knife cover facing the air knife base around the cleaning hole.

8. The dispensing device of claim 7, further comprising:

a base; and a waste receptacle formed on the base and is located below the cleaning assembly.

9. The dispensing device of claim 7, wherein:

the air guide groove is near the cleaning hole and forms an acute angle with the wall of the cleaning hole;

the diameter of the glue drop hole adjacent to the end of the air knife cover gradually increases in a direction toward the air knife cover.

10. The dispensing device of claim 9, wherein the air knife base further comprises a matching groove, wherein:

the matching groove is formed on the air knife base facing the air knife cover and opposite the air guide groove, and a wall surface of the matching groove forms an air hole, wherein the air hole couples to the air inlet connector.

* * * * *